United States Patent [19]

Presley et al.

[11] Patent Number: 5,074,513

[45] Date of Patent: Dec. 24, 1991

[54] ADJUSTABLE EASEL

[76] Inventors: Sterling L. R. Presley; Heather J. Presley, both of R.R. #2, Russell, Ontario, Canada, K0A 3B0

[21] Appl. No.: 597,079

[22] Filed: Oct. 15, 1990

[30] Foreign Application Priority Data

Feb. 26, 1990 [CA] Canada ..... 2010945

[51] Int. Cl.[5] ..... A47G 1/24

[52] U.S. Cl. ..... 248/454; 248/130; 248/458

[58] Field of Search ..... 248/454, 457, 458, 441.1, 248/447, 448, 450, 451, 452, 453, 129, 130, 131, 133, 149; 269/71, 236

[56] References Cited

U.S. PATENT DOCUMENTS 3,244,450 4/1966 Boutin .
3,512,745 5/1970 Gress ..... 248/453 X
3,926,398 12/1975 Vincent ..... 248/458 X
4,054,315 10/1977 Czarnowski .
4,109,892 8/1978 Hartung ..... 248/458 X
4,134,614 1/1979 Fielding, Sr. ..... 248/458 X
4,482,185 11/1984 Zoellner .
4,690,363 9/1987 Koves ..... 248/454 X
4,717,109 1/1988 Johnston ..... 248/458 X

FOREIGN PATENT DOCUMENTS 2211083 6/1989 United Kingdom .

*Primary Examiner*—Ramon O. Ramirez
*Attorney, Agent, or Firm*—Merchant, Gould, Smith, Edell, Welter & Schmidt

[57] ABSTRACT

An easel adapted for use by disabled persons provides a frame for holding a canvas which can be tilted by means of a crank and rotated to bring different parts of the canvas into convenient reach of the artist. The stand of the easel pivotally supports a plate on which the canvas-holding frame is rotatably mounted.

16 Claims, 4 Drawing Sheets

ADJUSTABLE EASEL

FIELD OF THE INVENTION

This invention relates to an easel. More particularly, it is directed to an easel adapted for use by disabled persons, such as those confined to a wheelchair or having limited mobility who cannot move about to work on all parts of a canvas supported on a conventional easel.

BACKGROUND OF THE INVENTION

On a conventional easel, an artist's canvas is fixed in one position and the artist must move himself or herself relative to the position of the canvas in order to work on all parts of it. In some conventional easels, the horizontal member on which the lower edge of the canvas rests can be set in different positions, i.e. higher or lower, to facilitate working on various parts of the canvas. Also, there are easels intended for use by an artist in a seated position. However, in known easels, it is not possible readily to move the canvas about, without removing it from the easel, to a variety of positions so that different parts of the canvas are moved close to the hand of an artist who is confined to a wheelchair and/or who has limited strength or ability to reach his or her hand and brush to parts of the canvas that are farther removed. Such an artist is faced with the task of removing the canvas from the easel, making adjustments to the canvas-holding members of the easel (if that is possible) and replacing the canvas on the easel in another position. This can be a time-consuming exercise involving considerable difficulty for the artist or for the person who assists the artist.

SUMMARY OF THE INVENTION

The present invention is directed to an easel in which the position of the canvas can be conveniently altered without removing it from the easel, to place different parts of the canvas within the convenient reach of a seated artist.

There is provided according to the invention an easel for supporting an artist's workpiece comprising frame means for holding a workpiece, a stand for supporting the frame means, means for pivoting the frame means about a first axis to incline the frame means at a selected angle from the stand, and means for rotating the frame means about a second axis substantially normal to the first axis.

There is further provided an easel for supporting an artist's workpiece comprising a stand, plate means pivotally affixed to the stand about a first axis, frame means for holding a workpiece, the frame means being rotatably mounted on the plate means about a second axis substantially normal to the first axis, whereby the frame means is inclinable at a selected angle from the stand by pivoting of the plate means.

There is further provided an easel for supporting an artist's canvas comprising a stand having two upright spaced-apart support members, a first axis generally horizontal to the ground supported by the support members, a plate pivotally supported by the support members about the first axis, a frame for holding a canvas, the frame being rotatably mounted on a second axis on the plate generally normal to and lower than the first axis, two cams rotatably mounted adjacent the ends of the first axis for engaging the frame and preventing rotation of the frame about the second axis, a cam rotatably mounted on the stand for engaging the plate proximate its lower edge and inclining the plate to a selected angle from the stand, a crank for rotating the cam, and a coil spring mounted on the stand for biasing the cam to rotate in a selected direction, and a table mounted on the stand for holding an artist's supplies.

BRIEF DESCRIPTION OF THE DRAWINGS

In drawings which illustrate embodiments of the invention.

DETAILED DESCRIPTION OF THE PREFERRED EMBODIMENTS

Figure 1:
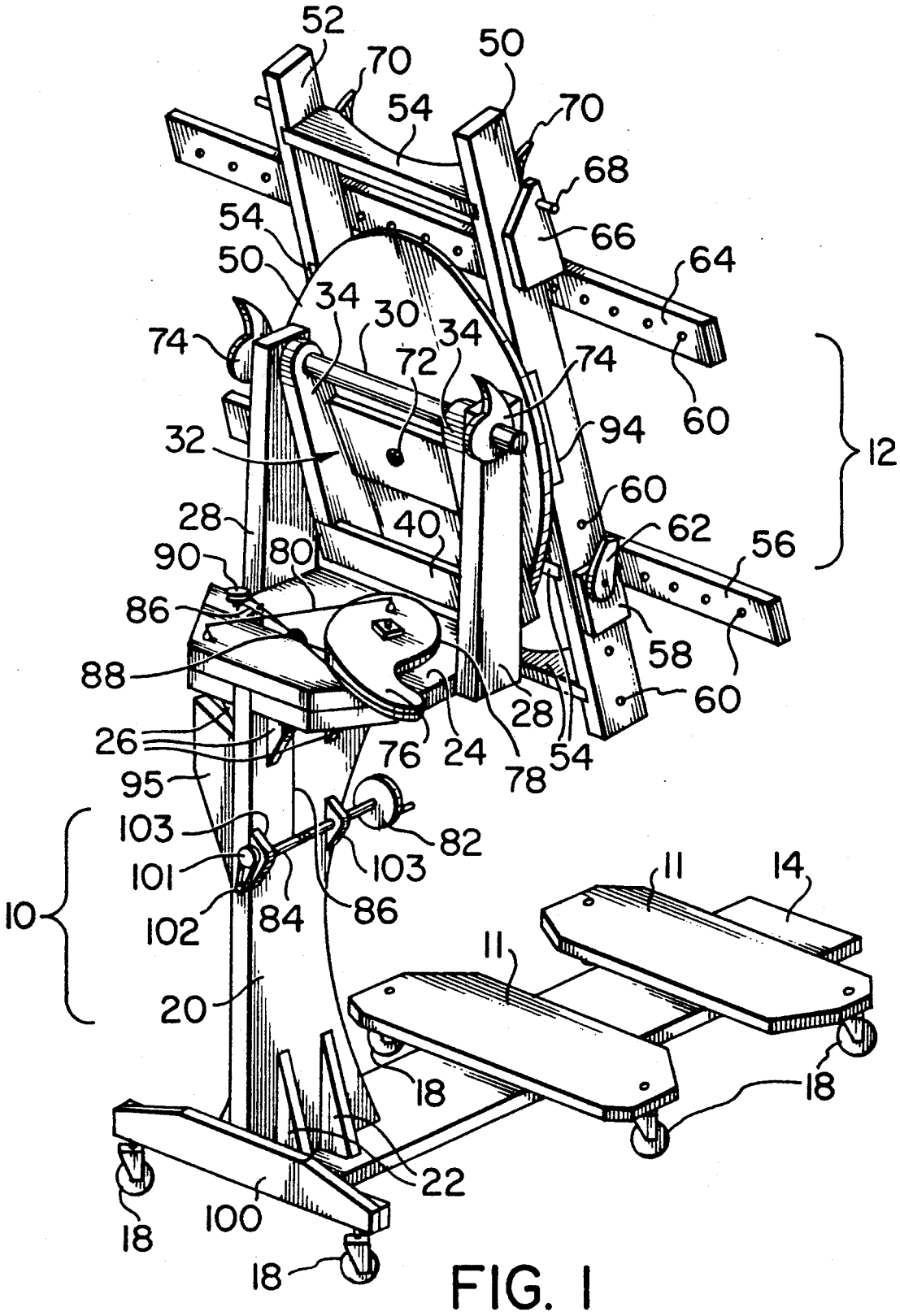
FIG. 1 a rear perspective view of one embodiment of the easel showing the frame in a tilted position.

The easel comprises a stand, indicated generally by reference numeral 10 in FIG. 1, which supports a frame means, indicated generally by reference numeral 12. Stand 10 has forwardly-extending base 14 to which are affixed two laterally-extending base members 11 and bracing plate 100 to provide stability to the easel. Castors 18 are affixed to base members 11 and bracing plate 100 to facilitate moving the easel about.

Stand 10 has vertically-extending support member 20 mounted on base 14. Buttress members 22 are affixed to base 14 and to support member 20 on either side thereof. Stand 10 also comprises mounting plate 24 affixed to the upper end of support member 20. Buttress members 26 are affixed to either side of support member 20 and to the underside of mounting plate 24. A pair of support members 28 are affixed to opposite lateral edges of mounting plate 24 and extend upwardly therefrom.

A laterally-extending bore is provided near the upper end of each support member 28, and rod 30 is supported therein in a horizontal position. Plate means 32 is pivotally supported on rod 30. Plate means 32 comprises two parallel members 34 which have a bore through the upper part thereof for pivotal engagement on rod 30. Plate means 32 also comprises brace member 40 which extends between the lower ends of members 34, and member 36 which extends between members 34 and is rigidly affixed thereto. Plate means 32 is a rigid unit which pivots as a whole on rod 30. A bore is provided in member 36 for mounting the frame means 12 which holds the artist's canvas, as described below.

Frame means 12 has circular board 50 on which are rigidly affixed spaced-apart parallel generally vertically-extending members 52. Members 52 are reinforced by cross-members 54 and forward securing plate 94, which are rigidly affixed thereto. Adjustable means for holding a canvas is provided as follows. Horizontally-disposed bar 56 is rigidly affixed to two L-shaped members 58 so spaced as to lie proximate the outer faces of members 52. Members 52 have a plurality of pairs of matching bores 60 extending laterally therethrough. L-shaped members 58 also have bores extending therethrough. Pin 62 fits snugly but removably in the bore in L-shaped members 58 and in bore 60 to hold bar 56 in a selected position on members 52. A lower or higher position for bar 56, which supports the lower edge of a canvas, can be selected by choosing a desired pair of bores 60 in members 52.

The upper edge of a canvas is held by bar 64. In use, bar 64 presses firmly down on the upper edge of the canvas, holding it securely against the upper edge of bar 56. Additionally, screws extend upwardly through bar 56 into the lower edge of the canvas and downwardly through bar 64 into the upper edge of the canvas to further secure it in place.

Bar 64 is adjustably affixed to members 52 as follows. Two blocks 66 are rigidly affixed to bar 64 which are spaced apart to lie proximate the outer faces of members 52. Rod 68 extends horizontally between said blocks and is rigidly affixed thereto. Cams 70 are rotatably disposed on rod 68 proximate the anterior face of members 52. When rotated, the cams engage and disengage the anterior face of members 52, locking and unlocking bar 64 in position on members 52. Thus, to affix a canvas to frame means 12, the canvas is placed on bar 56; bar 64 is placed against the top edge of the canvas and cams 70 are rotated to engage supports 52 and lock bar 64 in position. The screws through bars 56 and 64 are then tightened into the bottom and top edges of the canvas.

Frame means 12 is rotatably mounted on plate means 32. A bore is provided through plate 34 and through the center of board 50, and a bolt 72 is affixed therethrough to hold board 50 rotatably in place on plate means 32. Bolt 72 is substantially normal to rod 30 and forms an axis for the rotation of frame means 12.

Lock means are provided to hold board 50 in a selected position. A pair of cams 74 are rotatably disposed on the ends of rod 30. Rotation of cams 74 causes them to engage with and disengage from the posterior side of board 50. When disengaged, board 50 can rotate freely about bolt 72. When engaged, board 50 is locked in a selected position.

Figure 2:
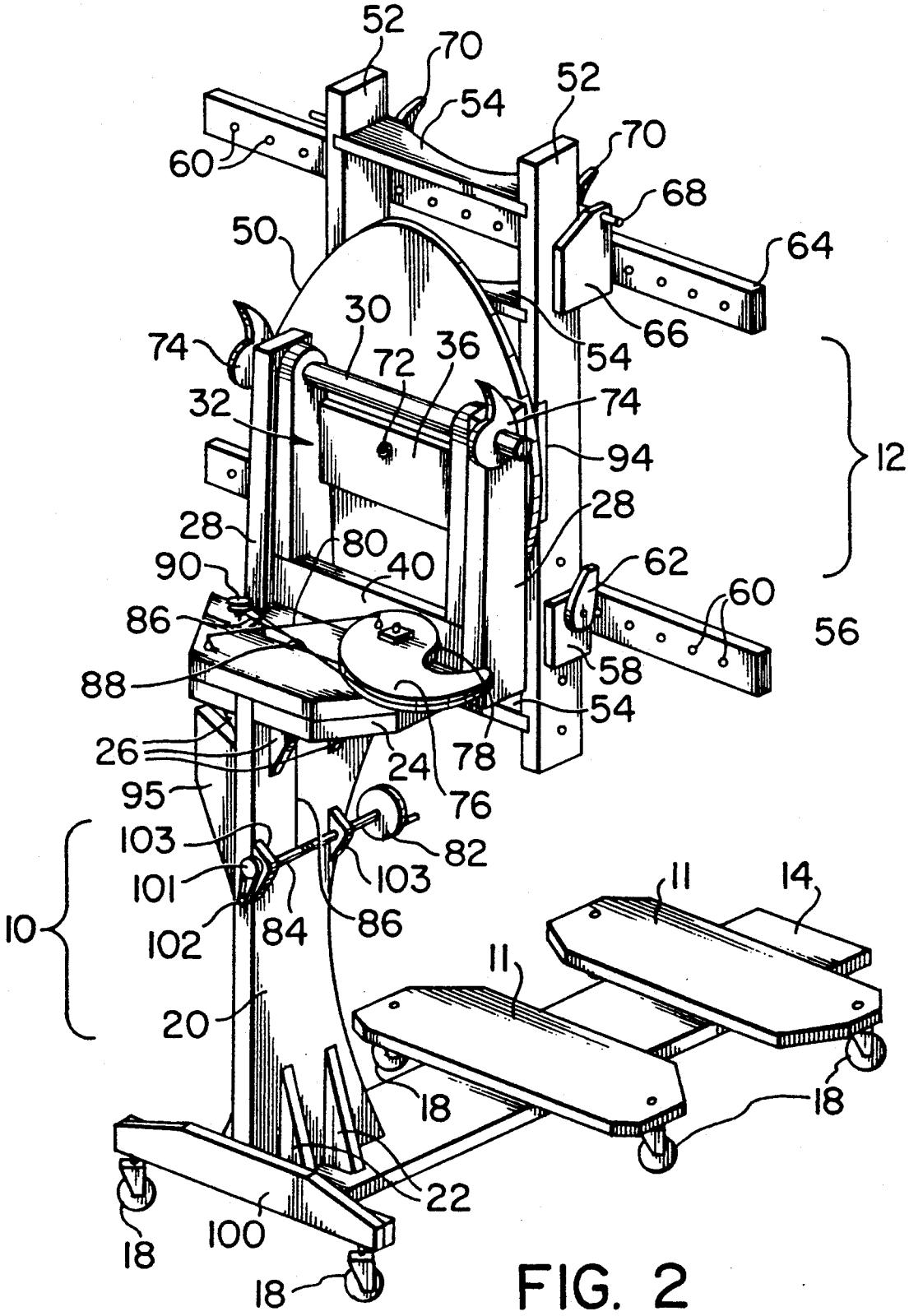
FIG. 2 is a rear perspective view of the embodiment of FIG. 1 showing the frame in an untilted position.

Frame means 12 can also be tilted to a selected angle. FIG. 2 shows the frame means 12 in an untilted position and FIG. 1 illustrates the tilted position. As described above, plate means 32 is pivotally hung from rod 30. When plate means 32 pivots, board 50 (with members 52 and bars 56 and 64 and the canvas attached thereto) is tilted. In the untilted position of FIG. 2, members 52 are substantially vertical.

The following means are provided to effect the tilting. Cam 76 is rotatably mounted on mounting plate 24, so that cammed surface 78 engages member 40 of plate means 32. As cam 76 is rotated, cammed surface 78 pushes against member 40, tilting plate means 32 outward, to the position shown in FIG. 1. Coil spring 80 is affixed between mounting plate 24 and cam 76 to bias cam 76 to the position in which plate means 32 will not be tilted, i.e. the position shown in FIG. 2. Crank means are provided to rotate the cam against the bias of spring 80. Crank 82 with shaft 84 is mounted on the side of stand 10 below mounting plate 24, as shown in FIGS. 1 and 2. Shaft 84 is rotatably attached to stand 20 by brackets 103. Wheel 101 is affixed to the rearward end of shaft 84. A rawhide strip or belt extends from the circumference of wheel 101 to the circumference of wheel 102, which is fixedly attached to the back of stand 20. The frictional force between the rawhide strip and wheel 102 helps maintain crank 82 in any selected position. Cable 86 is affixed to shaft 84 and extends through a hole in mounting plate 24, and over pulleys 88 and 90 which are affixed to mounting plate 24. The other end of cable 86 is affixed to an edge of cam 76 as shown in FIG. 2. When crank 82 is rotated, cable 86 is wound around shaft 84 and cam 76 is thereby rotated, tilting plate means 32 and frame means 12.

Figure 3:
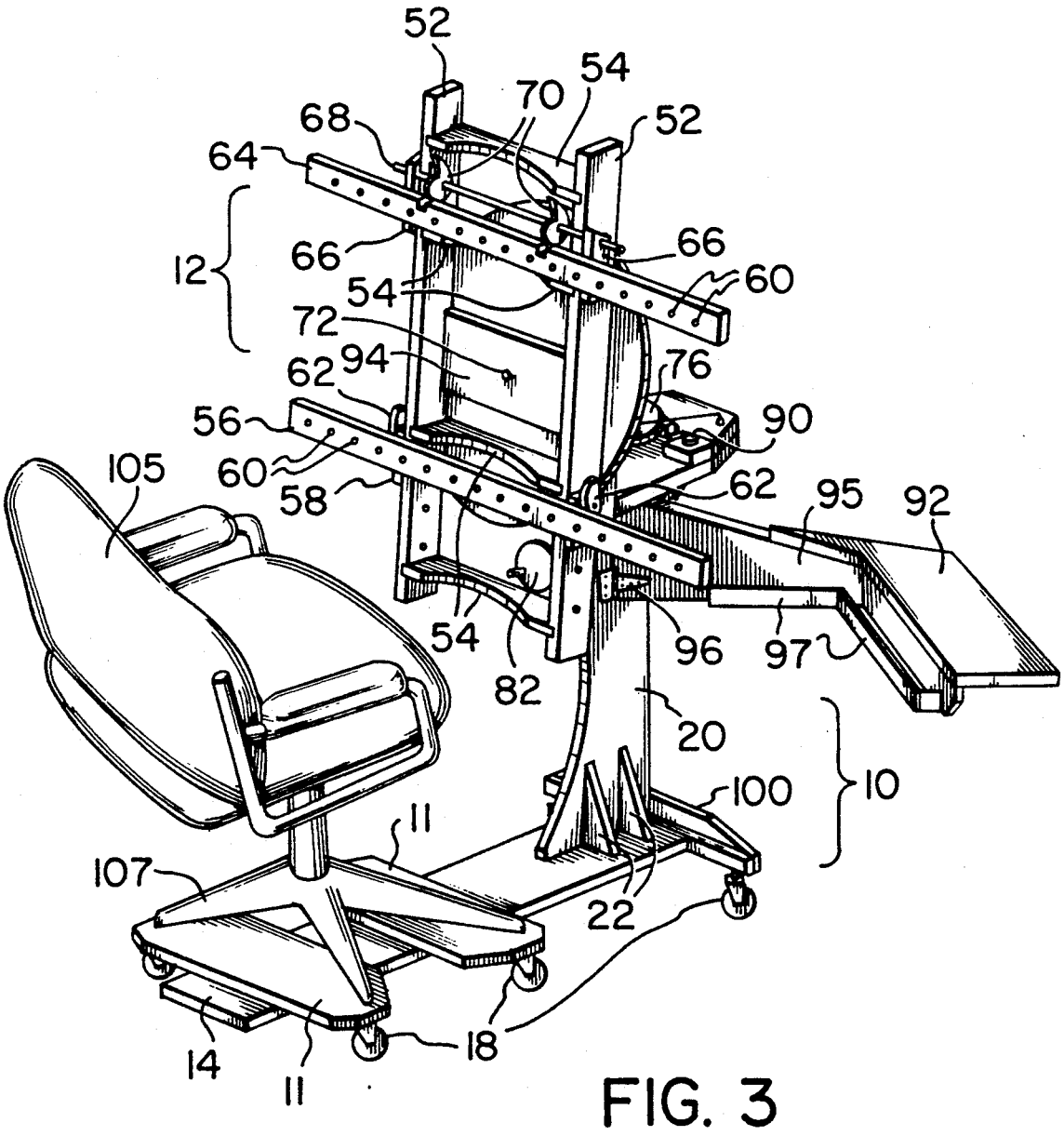
FIG. 3 is a front perspective view of the embodiment of FIG. 1 with a chair affixed to the easel.
Figure 4:
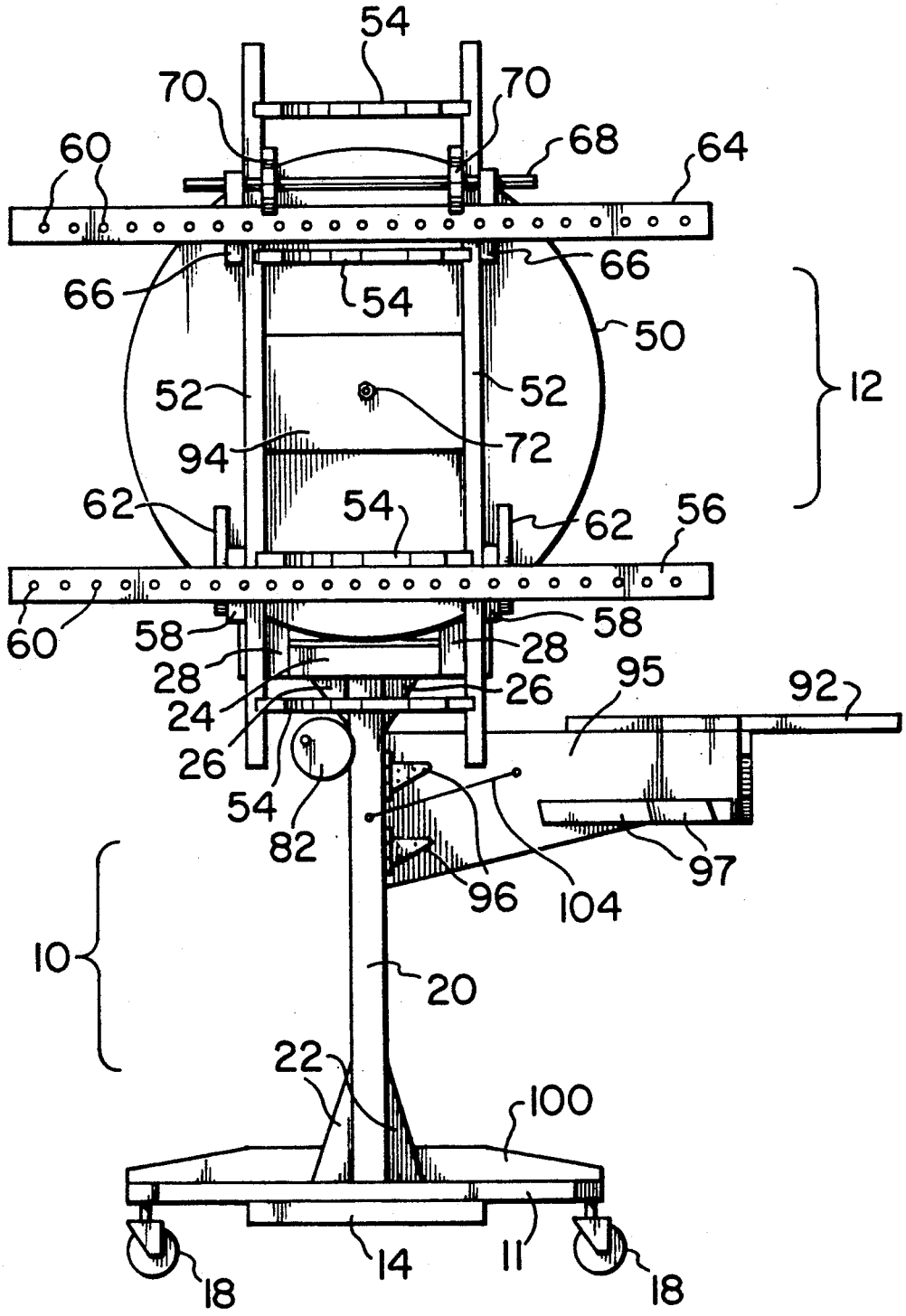
FIG. 4 is a front elevation view of the embodiment of FIG. 1.

As shown in FIG. 3, table 92 is pivotally secured by hinges 96 to the side of support member 20, for holding the artist's paints, etc. in a convenient position. It comprises arm assembly 95, to which are affixed paint holders 97 and a horizontal table portion, which can be used as a palate. Coil spring 104, shown in FIG. 4, extends between the front edge of stand 20 and the front side of arm 95 and holds table 92 in the forward position for use by the artist. The tension of spring 104 is such that table 92 can be pushed backward with a light push.

To use the easel, bar 56 is set at a selected height and a canvas is attached to frame means 12 as described above. Tilting of the canvas to a desired angle can then be done by the artist while remaining seated by turning crank 82. When the artist wishes to bring a part of the canvas that is difficult to reach closer to hand, cams 74 are rotated to disengage from board 50, frame means 12 is rotated to the desired position, and cams 74 are rotated to re-engage board 50, locking frame means 12 in position. An artist confined to a wheelchair may require assistance to move cams 74.

In an alternative embodiment, shown in FIG. 3, chair 105 on base 107 is mounted on base members 11 at a suitable distance from stand 10 for use as a seat by the artist. Chair 105 can be a fixed or swivel chair, and can be removable for access by a wheelchair. When chair 105 is not included (as in FIG. 1), the artist would sit in a wheelchair, the wheels of which would be positioned laterally beyond the ends of base members 11.

The preferred embodiments of the invention have been described above, but it will be apparent to a reader skilled in the art that many alternative configurations could be used to practice the present invention. For example, there are numerous ways in which a canvas could be attached to the frame. Several means other than cam 76 could be used for tilting the frame. Plate means 32 could take a variety of forms, for example a unitary member, and the mechanical configuration for tilting the frame means relative to the stand could be structured in a number of ways. All such alternate configurations are within the scope of the present invention, which is defined in the appended claims.

What is claimed is:

1. An easel for supporting an artist's workpiece comprising:

(a) frame means for holding a workpiece;

(b) a stand for supporting said frame means;

(c) a first axis, horizontal and fixed in position relative to said stand and supported thereby;

(d) means for pivoting said frame means about said first axis to incline said frame means at a selected angle from said stand;

(e) a second axis pivotable about said first axis and substantially normal thereto; and (f) means for rotating said frame means about said second axis.

2. An easel according to claim 1 wherein said frame means is adapted to hold canvasses of various sizes.

3. An easel according to claim 1 wherein said pivoting means includes cam means rotatably mounted on said stand for inclining said frame means.

4. An easel according to claim 3 further including crank means for rotating said cam means.

5. An easel according to claim 4 further including means for biasing said cam means to rotate in a selected direction.

6. An easel for supporting an artist's workpiece comprising:

(a) a stand;

(b) plate means pivotally affixed to said stand about a first axis;

(c) frame means for holding a workpiece, said frame means being rotatably mounted on said plate means about a second axis substantially normal to said first axis;

(d) whereby said frame means is inclinable at a selected angle from said stand by pivoting of said plate means.

7. An easel according to claim 6 wherein said frame means is adapted to hold canvasses and other workpieces of various sizes.

8. An easel according to claim 6 further including cam means rotatably mounted on said stand for inclining said plate to a selected angle from said stand.

9. An easel according to claim 8 further including crank means for rotating said cam means.

10. An easel according to claim 9 further including means for biasing said cam means to rotate in a selected direction.

11. An easel according to claim 6 further including lock means to prevent rotation of said frame means about said second axis.

12. An easel according to claim 11 wherein said lock means is a cam rotatably mounted on said stand.

13. An easel according to claim 6 further including a table mounted on said stand for holding an artist's supplies.

14. An easel for supporting an artist's canvas comprising:

(a) a stand having two upright spaced-apart support members;

(b) a first axis generally horizontal to the ground supported by said support members;

(c) a plate pivotally supported by said support members about said first axis;

(d) a frame for holding a canvas, said frame being rotatably mounted on a second axis on said plate generally normal to and lower than said first axis;

(e) two cams rotatably mounted adjacent the ends of said first axis for engaging said frame and preventing rotation of said frame about said second axis;

(f) a cam rotatably mounted on said stand for engaging said plate proximate its lower edge and inclining said plate to a selected angle from said stand, a crank for rotating said cam, and a coil spring mounted on said stand for biasing said cam to rotate in a selected direction; and (g) a table mounted on said stand for holding an artist's supplies.

15. An easel according to claim 14 further comprising a chair affixed to said stand.

16. An easel according to claim 14 in which said stand is supported by a plurality of ground-engaging wheels.

* * * * *